US006595513B2

(12) United States Patent
Dobbertin et al.

(10) Patent No.: US 6,595,513 B2
(45) Date of Patent: Jul. 22, 2003

(54) LEVELING DEVICE TO ACCOMMODATE PAPER WITH AT LEAST TWO SECTIONS OF DIFFERENT THICKNESSES

(75) Inventors: Michael T. Dobbertin, Honeoye, NY (US); James G. Amorese, Webster, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 94 days.

(21) Appl. No.: 09/751,193

(22) Filed: Dec. 28, 2000

(65) Prior Publication Data

US 2002/0084575 A1 Jul. 4, 2002

(51) Int. Cl.[7] ..... B65H 1/08
(52) U.S. Cl. ..... 271/148
(58) Field of Search ..... 271/148

(56) References Cited

U.S. PATENT DOCUMENTS 3,720,407 A * 3/1973 Woodward ..... 271/161
4,558,859 A * 12/1985 Duke et al. ..... 271/148
4,711,443 A * 12/1987 Fujiwara et al. ..... 271/148
4,942,435 A 7/1990 Kneisel et al.
5,364,087 A * 11/1994 Schieck et al. ..... 271/148
5,511,773 A * 4/1996 Burger ..... 271/148
6,039,315 A * 3/2000 Lim ..... 271/127
6,283,469 B1 * 9/2001 Weber ..... 271/148
6,315,284 B1 * 11/2001 Komuro et al. ..... 271/148

FOREIGN PATENT DOCUMENTS

JP 4-327433 * 11/1992 ..... 271/148

* cited by examiner

*Primary Examiner*—Michael R. Mansen
(74) *Attorney, Agent, or Firm*—Kathleen K. Bowen

(57) ABSTRACT

A leveling device is useful for paper having at least two different thicknesses for a paper supply tray having a given depth, for a sheet feeder. This leveling device comprises a support upon which the paper having at least two different thicknesses rests, wherein the support height is self adjusting to compensate for the different thicknesses of the paper such that a top sheet of paper is in a position to feed properly into the sheet feeder.

9 Claims, 5 Drawing Sheets

LEVELING DEVICE TO ACCOMMODATE PAPER WITH AT LEAST TWO SECTIONS OF DIFFERENT THICKNESSES

BACKGROUND

The present invention is in the field of printers and copiers. Specifically this invention relates to paper supply platforms.

It is often desirable to print on paper which has two sections of substantially different thickness, such as paper with a peel-off mailing label. This non-uniformity causes the top of the stack to have a differential height in the crosstrack direction in the paper supply. This differential thickness severely limits the amount of paper which the paper supply can hold and still maintain reliable feed performance.

A paper supply tray is desired with a device which will hold paper with at least two sections of substantially different thicknesses such that the top of the paper stack remains level, and the effective paper supply capacity is increased substantially.

SUMMARY OF THE INVENTION

According to an aspect of the invention, a leveling device is disclosed which is useful for paper having at least two different thicknesses for a paper supply tray having a given depth, for a sheet feeder, which comprises a support upon which the paper having at least two different thicknesses rests, wherein the support height is self-adjusting to compensate for the different thicknesses of the paper such that a top sheet of paper is in a position to feed properly into the sheet feeder.

DETAILED DESCRIPTION

Figure 1:
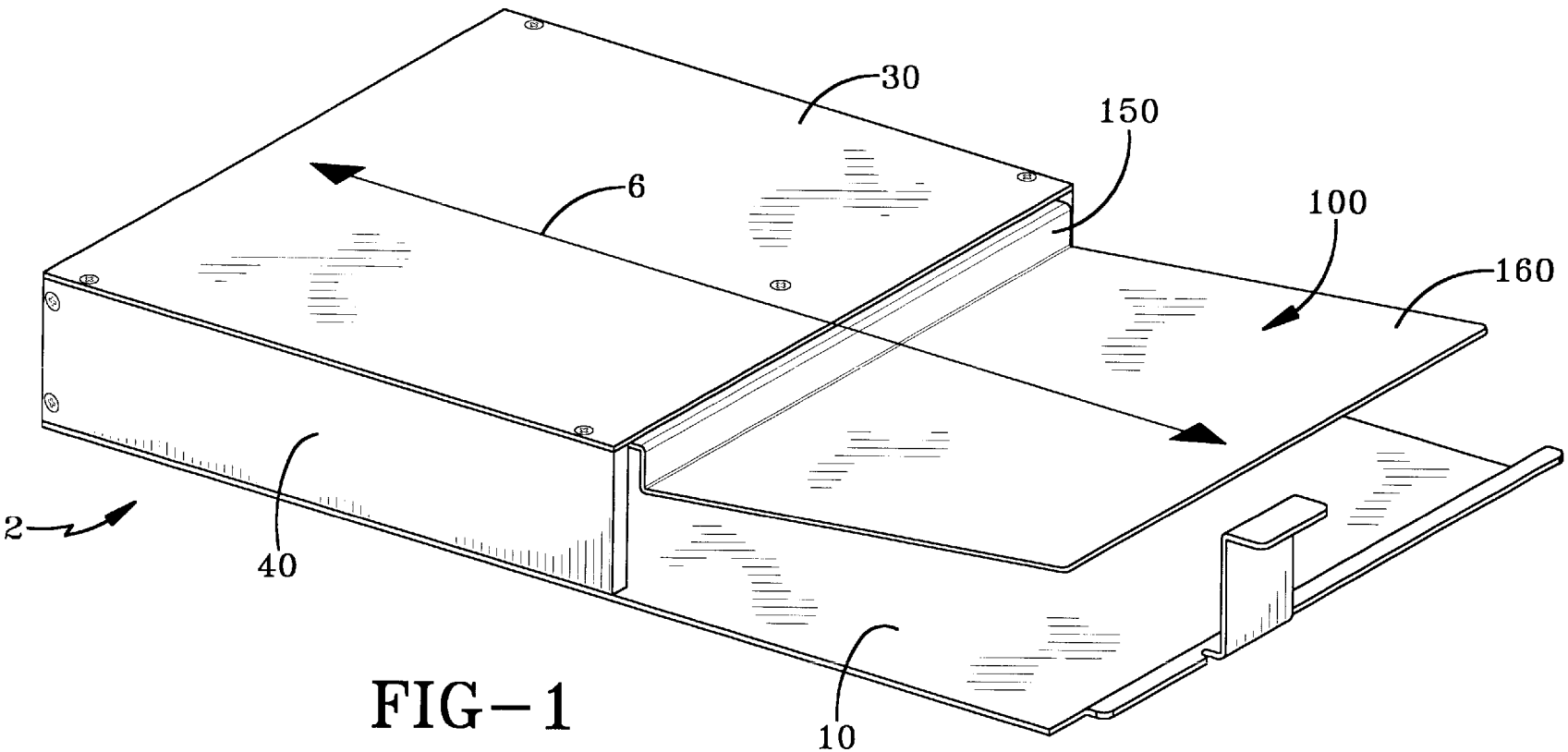
FIG. 1 is an isometric view of a leveling device for a paper tray according to an aspect of the invention.
Figure 2:
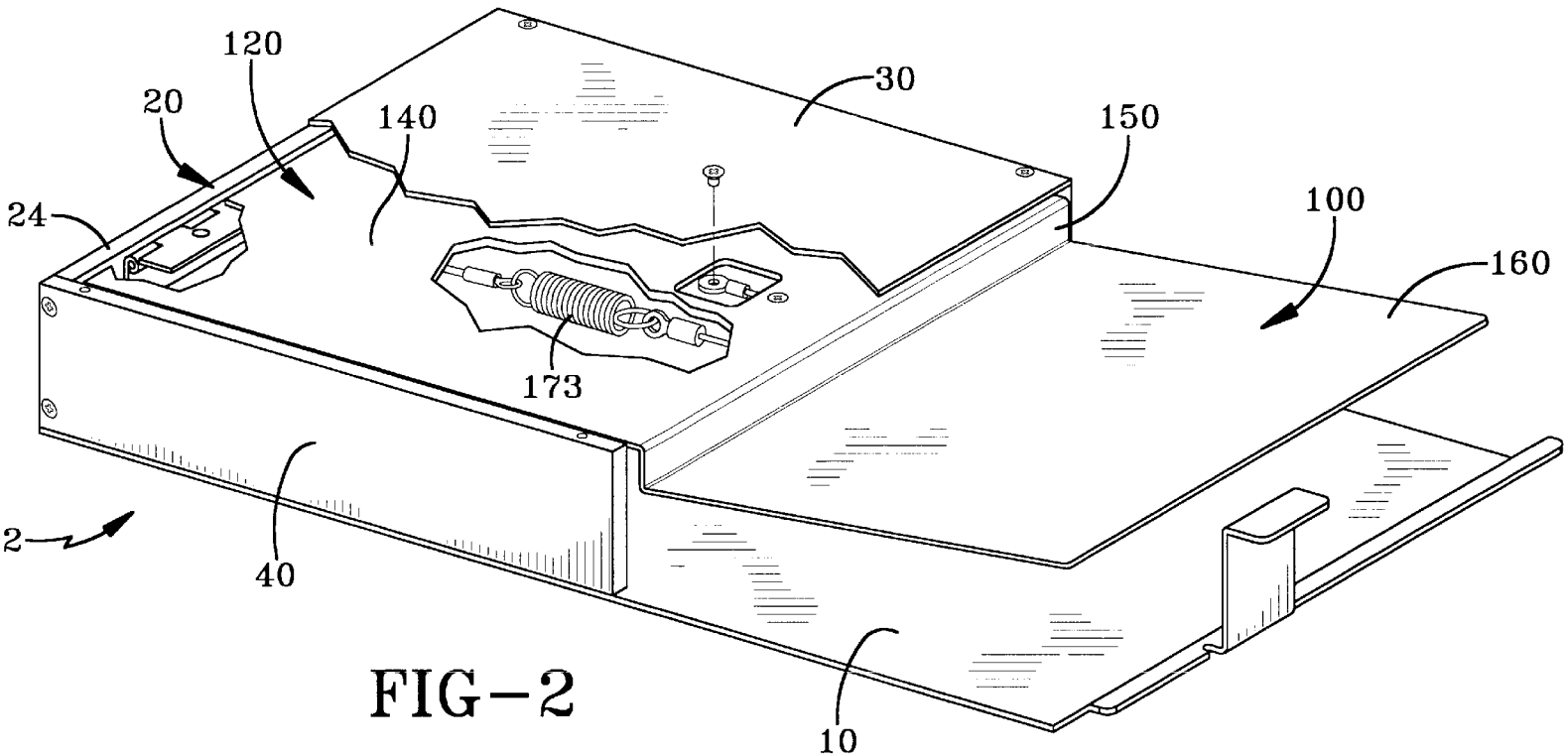
FIG. 2 is an isometric view of a leveling device for a paper tray, with a cut away section, according to an aspect of the invention.

Various aspects of the invention are presented in FIGS. 1–8 which are not drawn to scale and in which like components are numbered alike. Referring now to these Figures, according to an aspect of the invention a leveling device 2 for paper having at least two different thicknesses 50 for a paper supply tray having a given depth, for a sheet feeder, which comprises a support upon which the paper having at least two different thicknesses 50 rests, wherein the support height is self-adjusting to compensate for the different thicknesses of the paper such that a top sheet of paper is in a position to feed properly into the sheet feeder. This means that in a typical sheet feed system where the sheet feeder is designed to accept paper which is planar, the top sheet of paper must be planar enough to be fed properly into the sheet feeder.

The direction perpendicular to the direction in which the paper is fed into the sheet feeder is the crosstrack direction 6. The paper 50 has a width 56, a thinner portion 54 and a thicker portion 52, wherein the thickness varies in the crosstrack direction 6. According to a preferred embodiment of the invention, the support comprises a rectangular top plate 30, and a rectangular pivot plate 100.

The rectangular top plate 30 has an edge one 32 and an opposing edge two 34 wherein edge one 32 and edge two 34 are perpendicular to the crosstrack direction 6. Edge one 32 and edge two 34 are separated by a distance which is less than the length of the thinner portion of the paper 54 in the crosstrack direction 6. The length of the top plate edge one 32 and the top plate edge two 34 is equal to or slightly less than the width of the paper 56. The top plate 30 is mounted to the paper supply tray such that it is not at the top of the depth of the paper supply tray, and not at the bottom of the depth of the paper supply tray, and such that edge one 32 lines up with the non-crosstrack direction edge 58 of the thinner portion of the paper.

The pivot plate 100 is rectangular in shape, and has an edge three 120 and an opposing edge four 130, wherein edge three 120 and edge four 130 are perpendicular to the crosstrack direction 6. The length of edge three 120 and edge four 130 are equal to or slightly less than the width 56 of the paper 50. The pivot plate 100 is pivotally mounted to the paper supply tray by a pivotal attachment means. The pivotal attachment means 170 is spring loaded such that when paper of two different thicknesses is loaded onto the paper supply tray such that the thicker portion 52 is resting on the pivot plate 100, and the thinner portion 54 is resting on the top plate 30, the pivot plate 100 will rotate downward under the weight of the paper 50 such that a top sheet of paper is in a position to feed properly into the sheet feeder.

According to a further preferred embodiment, the rectangular pivot plate 100 edge three 120 and edge four 130 are separated by a distance which is equal to or slightly less than the length 57 of the paper 50 in the crosstrack direction, and wherein the pivot plate 100 is pivotally mounted to the paper supply tray such that the pivot plate 100 pivots about edge three 120, and such that edge three 120 is directly under the top plate edge one 32.

In a preferred embodiment of this invention, the pivot plate 100 is bent into three parallel rectangular sections, section one 140, section two 150, and section three 160, wherein edge three 120 is on section one 140, edge four 130 is on section three 160, and section two 150 is between section one 140 and section three 160. In this configuration, the length of section one 140 in the crosstrack direction 6 is approximately the same as the length of the top plate 30 in the crosstrack direction 6, and the length of section three 160 in the crosstrack direction 6 is substantially longer than the thicker portion of the paper 54. Section one 140 is parallel to the top plate 30, section two 150 angles away from the plane of the top plate 30, and section three 160 angles back up towards the plane of the top plate 30, such that when there is no paper in the paper supply tray the pivot plate edge four 130 is in the same plane as the top plate 30, and wherein no part of the pivot plate 100 is above the plane of the top plate 30.

Figure 3:
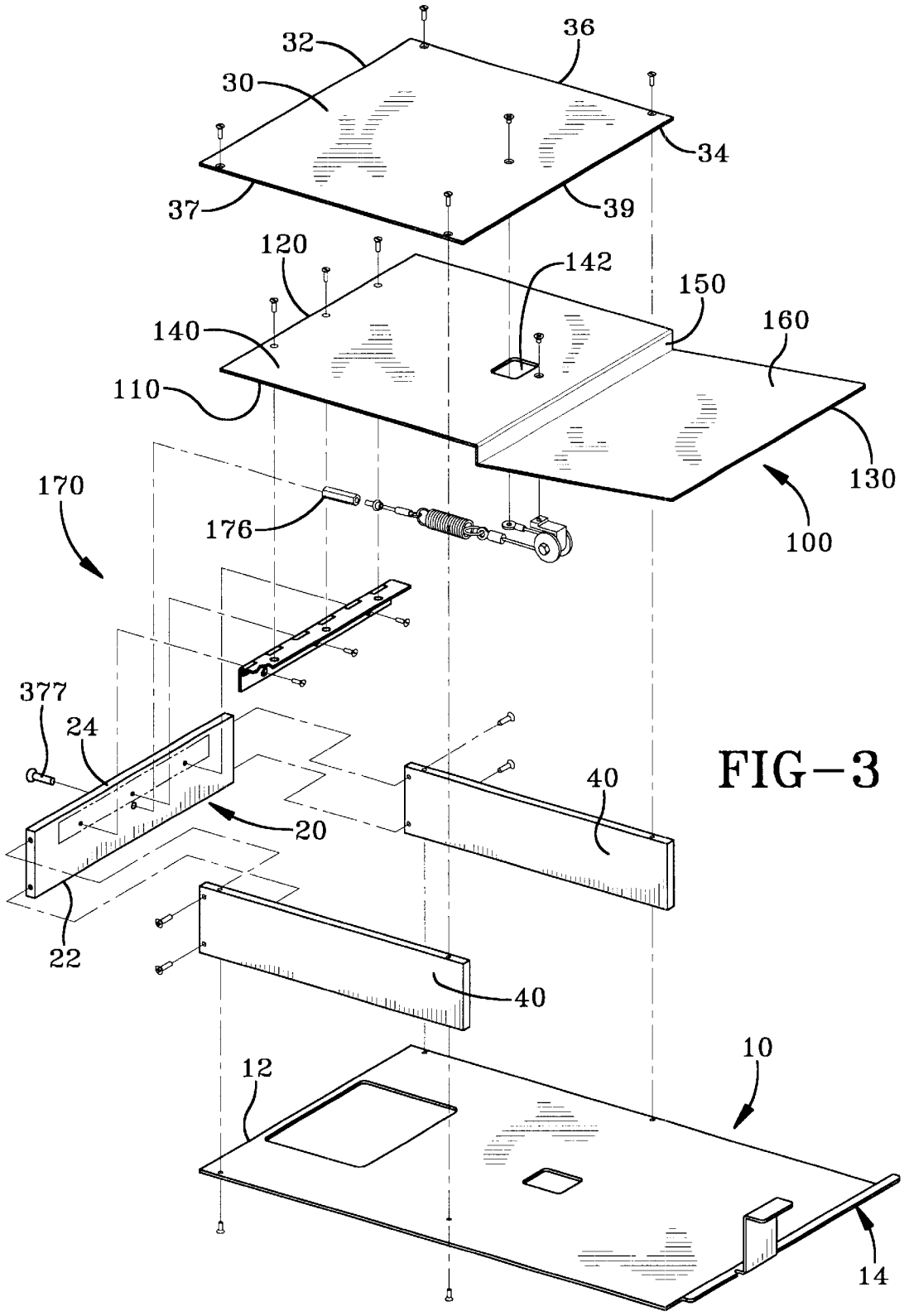
FIG. 3 is an exploded isometric view of a leveling device for a paper tray according to an aspect of the invention.
Figure 4:
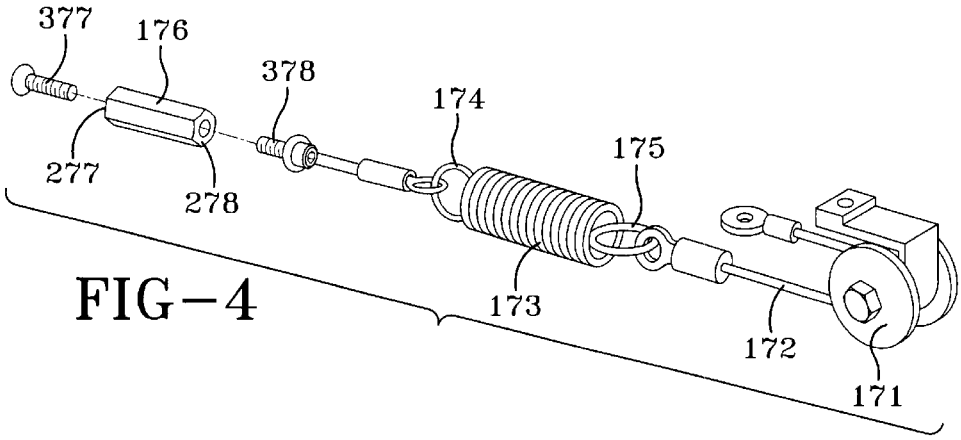
FIG. 4 is a view of spring loaded pulley device according to an aspect of the invention.

Referring now to FIGS. 3 and 4, the top plate 30 has a bottom side 39, which is the surface facing the pivot plate 100, and the pivot plate 100 has an underside 110, which is the surface not facing the top plate 30. According to a further aspect of the invention the spring loaded pivotal attachment means 170 comprises a pulley 171, a cable 172, and a spring 173. The pulley 171 is mounted to the underside 110 of the pivot plate 100 such that the pulley 171 is also under the top plate 30, and wherein the pivot plate 100 has a slot 142 located near the pulley 171. The cable 172 is mounted to the top plate bottom side 39 above the pivot plate slot 142, and is threaded through the slot 142, and threaded around the pulley 171.

The spring 173 has opposing ends, end one 174 and end two 175, wherein end one 174 is mounted to the paper tray, and end two 175 is attached to the cable 172 such that when there is no paper in the tray the force of the spring 173 on the cable 172 around the pulley 171 maintains the pivot plate 100 in the desired position. The pivot plate 100 essentially swings up and down, wherein the downward movement is caused by the weight of the paper 50, and the upward movement is caused by the force of the spring 173. The limit on the upward movement of the pivot plate 100 is the top plate 30, and the limit on the downward movement of the pivot plate 100 is the bottom of the paper tray.

In a preferred embodiment of this invention, the spring-loaded pivotal attachment means further comprises a mount nut 176, a mounting screw 377, and a connecting screw 378. The mount nut 176 has opposing ends, end three and end four, wherein each end has a threaded hole 277 and 278 respectively. The head of the connecting screw 378 is attached to the spring end one 174, and the threaded portion of the connecting screw 378 is threaded into the mount nut 176 at the threaded hole 278. The mounting screw 377 mounts the mount nut 176 to the paper supply tray by being threaded into the mount nut 176 at the threaded hole 277 to achieve a desired pre-load on the spring 173 such that when there is no paper in the paper tray the force of the spring 173 on the cable 172 around the pulley 171 maintains the pivot plate 100 in the desired position and when paper is resting on the support, a top sheet of paper is in a position to feed properly into the sheet feeder.

In a further preferred embodiment of this invention, the leveling device 2 further comprises a rectangular bottom plate 10. The bottom plate 10 has an edge five 12 and an opposing edge six 14, wherein edge five 12 and edge six 14 each span the width of the bottom plate 10. The width of the bottom plate 10 is equal to or slightly less than the width 56 of the paper 50, and the distance between edge five 12 and edge six 14 is equal to or slightly less than the length 57 of the paper 50. The bottom plate 10 is the bottom of the paper supply tray, and it is parallel to the top plate 30.

According to a further aspect of the invention, the leveling device 2 further comprises a rectangular end plate 20. The end plate 20 is perpendicular to the top plate 30 and the bottom plate 10, and essentially supports edge one 32 of the top plate 30 on edge five 12 of the bottom plate 10. The end plate 20 has a bottom edge 22 and an opposing top edge 24, wherein the bottom edge 22 and the top edge 24 each span the length of the end plate 20, and wherein the length of the end plate 20 is equal to the width of the bottom plate 10 and the top plate 30. The end plate bottom edge 22 is mounted to the bottom plate edge five 12, such that said end plate bottom edge 22 spans the bottom plate edge five 12. The top plate edge one 32 is mounted to the end plate top edge 24 such that the top plate edge one 32 spans the end plate top edge 24, and wherein the pivot plate edge three 120 is pivotally mounted to the end plate 20 directly below the top plate edge one 32.

In a preferred embodiment, the leveling device has support members 40 which span between the top plate 30 and the bottom plate 10, wherein the top plate 30 is supported along the length of the top plate 30 by the support members 40, such that the pivotal movement of the pivot plate 100 is not interfered with by the support members 40. In a further preferred embodiment, the support members 40 are rectangular plates extending along the entire length of the crosstrack direction edges of the top plate 30.

Figure 5:
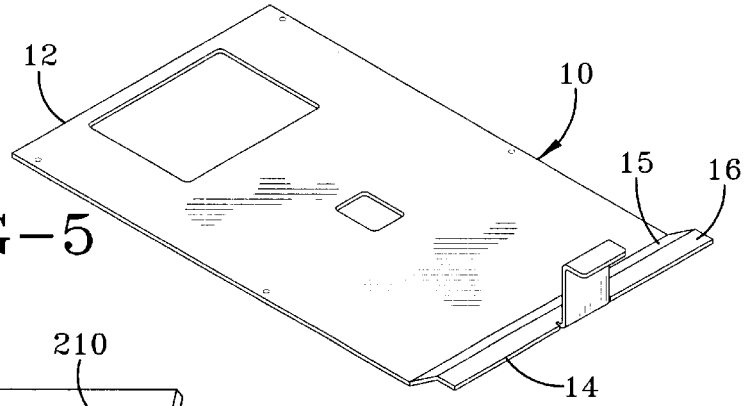
FIG. 5 is a detailed view of the bottom plate of a leveling device for a paper tray according to an aspect of the invention.

Referring now to FIG. 5, according to a further aspect of the invention, the bottom plate edge six 14 is bent into two parallel rectangular sections, section four 15 and section five 16, wherein section four 15 angles up into section five 16 which forms a small ledge at edge six 14. The combined lengths of section four 15 and section five 16 in the crosstrack direction 6 preferably do not exceed one inch.

Figure 6:
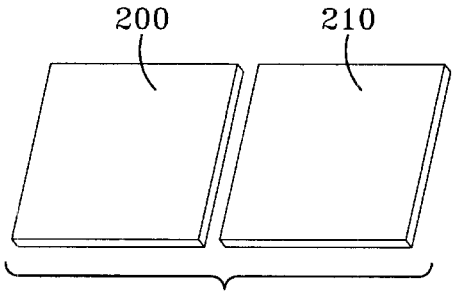
FIG. 6 is an isometric view of a leveling device for a paper tray according to an aspect of the invention.
Figure 7:
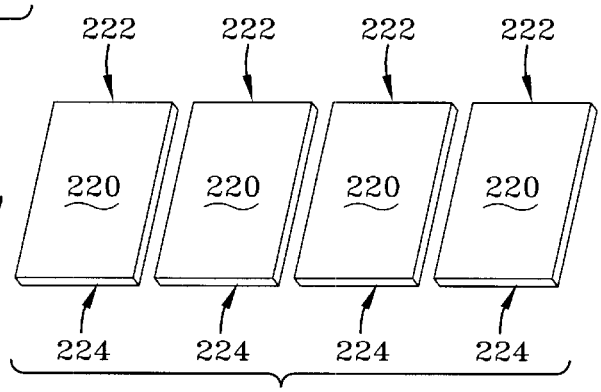
FIG. 7 is an isometric view of a leveling device for a paper tray according to an aspect of the invention.
Figure 8:
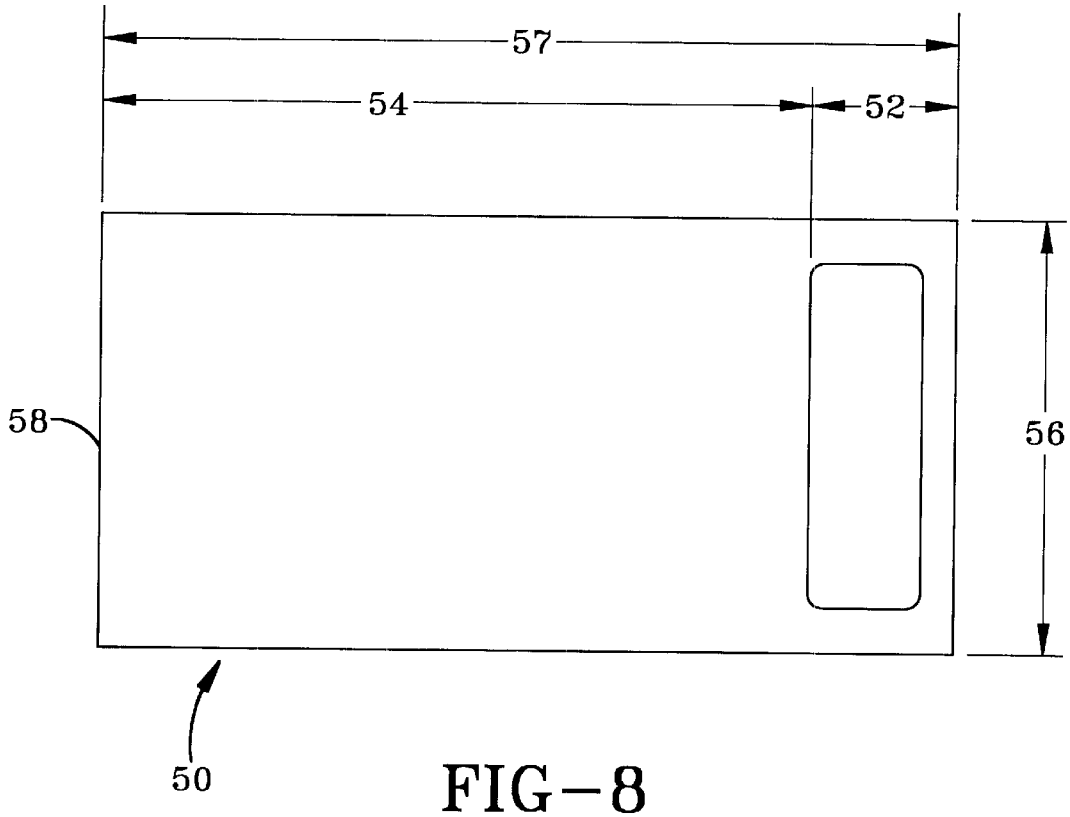
FIG. 8 is a top view of a paper with two different thicknesses due to the presence of a peel-off mailing label.

Referring now to FIG. 6, according to another aspect of the invention, the support may comprise a plate one 200 and a plate two 210. The plate one 200 is parallel to the desired paper configuration, with a width equal to or slightly less than the width 56 of the paper 50, and a length substantially shorter than the length of the thinner portion of the paper 54. The plate two 210 is parallel to the desired paper configuration, with a width equal to or slightly less than the width 56 of the paper 50, and a length substantially longer than the length of the thicker portion of the paper 52, such that the length of plate one combined with the length of plate two is equal to or slightly less than the length 57 of the paper 50. According to this aspect of the invention, plate one 200 and plate two 210 are independently driven to compensate for the weight difference of the different thickness paper such that a top sheet of paper is in a position to feed properly into the sheet feeder. According to a further aspect of the invention, plate one 200 and plate two 210 may be independently spring or motor driven to compensate for the weight difference of the different thickness paper such that a top sheet of paper is in a position to feed properly into the sheet feeder Referring now to FIG. 7 according to another aspect of the invention the support comprises multiple similar rectangular plates 220. The length of each rectangular plate 220 is equal to or slightly less than the width 56 of the paper 50, and the width of each rectangular plate 220 is approximately equal to the length 57 of the paper 50 divided by the number of plates. Each rectangular plate 220 has an edge one 222 and an opposing edge two 224 where edge one 222 and edge two 224 are the two shorter edges on each rectangular plate 220. The rectangular plates 220 are mounted to the paper supply tray such that when there is no paper in the tray, all the rectangular plates are in the same plane, which plane is parallel with the desired paper position, and all the edge ones 222 line up and all the edge twos 224 line up. The rectangular plates 220 are independently driven to compensate for the weight difference of the different thickness paper, thus the thicker portions of the paper weigh more and will subsequently force whichever plate it is resting on lower. Therefore both with a single sheet and with many sheets in the tray, a top sheet of paper is in a position to feed properly into the sheet feeder.

What is claimed is:

1. A leveling device for paper having at least two different thicknesses for a paper supply tray having a given depth, for a sheet feeder, wherein the direction perpendicular to the direction in which the paper is fed into the sheet feeder is the crosstrack direction, wherein the paper has a width, a thinner portion and a thicker portion, and wherein the thickness varies in the crosstrack direction comprising:

a rectangular top plate having an edge one and an opposing edge two wherein said edge one and said edge two are perpendicular to the crosstrack direction, wherein said edge one and said edge two are separated by a distance which is less than the length of the thinner portion of the paper in the crosstrack direction, and the length of said top plate edge one and said top plate edge two is equal to or slightly less than the width of the paper, wherein said top plate is mounted to the paper supply tray such that it is not at the top of the depth of the paper supply tray, and not at the bottom of the depth of the paper supply tray, and such that said edge one lines up with the non-crosstrack direction edge of the thinner portion of the paper; and, a rectangular pivot plate having an edge three and an opposing edge four, wherein said edge three and said edge four are perpendicular to the crosstrack direction, and wherein the length of said edge three and said edge four are equal to or slightly less than the width of the paper, and further wherein said edge three and said edge four are separated by a distance which is equal to or slightly less than the length of the paper in the crosstrack direction, wherein said pivot plate is pivotally mounted to the paper supply tray by a pivotal attachment means such that said pivot plate pivots about said edge three, and such that said edge three is directly under said top plate edge one, and wherein said pivotal attachment means is spring loaded such so as to be self adjusting to compensate for the different thicknesses of the paper such that when paper of two different thicknesses is loaded onto said paper tray such that the thicker portion is resting on said pivot plate, and the thinner portion is resting on said top plate, said pivot plate will rotate downward under the weight of the paper such that a top sheet of paper is in a position to feed properly into the sheet feeder.

2. The leveling device of claim 1 wherein said pivot plate is bent into three parallel rectangular sections, section one, section two, and section three, wherein said edge three is on said section one, said edge four is on said section three, and said section two is between said section one and said section three, wherein the length of said section one in the crosstrack direction is approximately the same as the length of said top plate in the crosstrack direction, and the length of said section three in the crosstrack direction is substantially longer than the thicker portion of the paper, wherein said section one is parallel to said top plate, said section two angles away from the plane of said top plate, and said section three angles back up towards the plane of said top plate such that when there is no paper in said paper supply tray said pivot plate edge four is in the same plane as said top plate, and wherein no part of said pivot plate is above the plane of said top plate.

3. The leveling device of claim 1 wherein said top plate has a bottom side, which is the surface facing said pivot plate, and wherein said pivot plate has an underside, which is the surface not facing said top plate, wherein said spring loaded pivotal attachment means comprises:

a pulley mounted to the underside of said pivot plate such that said pulley is also under said top plate, wherein said pivot plate has a slot located near said pulley;

a cable mounted to said top plate bottom side above said pivot plate slot, and wherein said cable is threaded through said slot, and threaded around said pulley; and, a spring having opposing ends, end one and end two, wherein said end one is mounted to the paper tray, and said end two is attached to said cable such that when there is no paper in said tray the force of said spring on said cable around said pulley maintains said pivot plate in the desired position.

4. The leveling device of claim 1 wherein said spring loaded pivotal attachment means further comprises:

a mount nut having opposing ends, end three and end four, wherein said end three has a threaded hole three, and said end four has a threaded hole four;

a connecting screw wherein the head of said connecting screw is attached to the spring end one, and the threaded portion of said connecting screw is threaded into said mount nut at the threaded hole four; and, a mounting screw which mounts said mount nut to the paper supply tray by being threaded into said mount nut at said threaded hole three to achieve a desired pre-load on said spring such that when there is no paper in the paper tray the force of said spring on said cable around said pulley maintains said pivot plate in the desired position and when paper is resting on said support, a top sheet of paper is in a position to feed properly into the sheet feeder.

5. The leveling device of claim 1 further comprising a rectangular bottom plate having an edge five and an opposing edge six, wherein said edge five and said edge six each span the width of said bottom plate, and wherein the length of said edge five and said edge six is equal to or slightly less than the width of the paper, and the distance between said edge five and said edge six is equal to or slightly less than the length of the paper in the crosstrack direction, wherein said bottom plate is parallel to said top plate, and wherein said bottom plate is the bottom of the paper supply tray.

6. The leveling device of claim 5 further comprising:

a rectangular end plate which is perpendicular to said top plate and said bottom plate, wherein said end plate has a bottom edge and an opposing top edge, and wherein said end plate bottom edge is mounted to said bottom plate edge five, and such that said end plate bottom edge spans said bottom plate edge five, and wherein said top plate edge one is mounted to said end plate top edge such that said top plate edge one spans said end plate top edge, and wherein said pivot plate edge three is pivotally mounted to said end plate directly below said top plate edge one.

7. The leveling device of claim 5 further comprising:

support members spanning between said top plate and said bottom plate, wherein said top plate is supported along the length of said top plate by said support members, such that the pivotal movement of said pivot plate is not interfered with by said support members.

8. The leveling device of claim 7 wherein said support members are rectangular plates extending along the entire length of said top plate in the crosstrack direction.

9. The leveling device of claim 5 wherein said bottom plate edge six is bent into two parallel rectangular sections, section four and section five wherein section four angles up into section five which forms a small ledge at edge six, wherein the combined lengths of said section four and said section five in the crosstrack direction do not exceed one inch.

* * * * *